US010163594B2

(12) United States Patent
Nakayama et al.

(10) Patent No.: US 10,163,594 B2
(45) Date of Patent: Dec. 25, 2018

(54) ELECTROMAGNETIC RELAY

(71) Applicant: FUJITSU COMPONENT LIMITED, Tokyo (JP)

(72) Inventors: Shigeki Nakayama, Tokyo (JP); Katsuyuki Takahashi, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 15/480,748

(22) Filed: Apr. 6, 2017

(65) Prior Publication Data

US 2017/0316906 A1 Nov. 2, 2017

(30) Foreign Application Priority Data

May 2, 2016 (JP) ..... 2016-092754

(51) Int. Cl.

| | |
|---|---|
| ***H01H 13/04*** | (2006.01) |
| ***H01H 50/02*** | (2006.01) |
| ***H01H 50/14*** | (2006.01) |
| ***H01H 50/04*** | (2006.01) |
| *H01H 50/64* | (2006.01) |
| *H01H 1/26* | (2006.01) |

(52) U.S. Cl.
CPC ..... *H01H 50/02* (2013.01); *H01H 50/042* (2013.01); *H01H 50/14* (2013.01); *H01H 50/642* (2013.01); *H01H 2001/265* (2013.01); *H01H 2050/046* (2013.01)

(58) Field of Classification Search
CPC ..... H01H 50/56; H01H 67/02
USPC ..... 335/202
See application file for complete search history.

(56) References Cited

U.S. PATENT DOCUMENTS 5,357,230 A * 10/1994 Mikawa ..... H01H 51/2281 335/128
5,907,268 A * 5/1999 Mader ..... H01H 50/042 335/130
5,951,335 A * 9/1999 Kurotori ..... H01R 12/83 439/733.1
6,046,661 A * 4/2000 Reger ..... H01H 50/56 335/185

(Continued)

FOREIGN PATENT DOCUMENTS

CN 1194447 A 9/1998
CN 104425187 A 3/2015

(Continued)

OTHER PUBLICATIONS

Extended European Search Report for corresponding European Patent Application No. 17165847.9, dated Sep. 28, 2017.

(Continued)

*Primary Examiner* — Shawki S Ismail
*Assistant Examiner* — Lisa Nhung Homza
(74) *Attorney, Agent, or Firm* — Staas & Halsey LLP

(57) ABSTRACT

An electromagnetic relay including: a base unit that includes a slit having a first wall part and a second wall part, and a first projection projecting from the first wall part of the slit; a terminal that is press-fitted into the slit, and includes a second projection at a position opposite to the first projection; and a preventer that prevents deviation of the second projection against the first projection when the terminal is press-fitted into the slit.

9 Claims, 9 Drawing Sheets

(56) References Cited

U.S. PATENT DOCUMENTS

| | | | | |
|---|---|---|---|---|
| 6,906,604 | B1 * | 6/2005 | Mader | H01H 50/642 335/128 |
| 7,038,563 | B2 * | 5/2006 | Andoh | H01H 50/443 335/126 |
| 7,504,915 | B2 * | 3/2009 | Takayama | H01H 50/24 335/128 |
| 7,659,800 | B2 * | 2/2010 | Gruner | H01H 1/26 335/185 |
| 8,558,647 | B2 * | 10/2013 | Shinkai | H01H 11/00 335/78 |
| 9,093,239 | B2 * | 7/2015 | Kato | H01H 50/642 |
| 9,741,516 | B2 * | 8/2017 | Takahashi | H01H 50/12 |
| 9,793,078 | B2 * | 10/2017 | Takahashi | H01H 50/56 |
| 2004/0113729 | A1 | 6/2004 | Sanada et al. | |
| 2015/0054603 | A1 | 2/2015 | Kato et al. | |
| 2015/0235792 | A1 * | 8/2015 | Takahashi | H01H 50/56 335/127 |

FOREIGN PATENT DOCUMENTS

| | | |
|---|---|---|
| DE | 1805583 | 11/1969 |
| DE | 2536740 | 2/1977 |
| DE | 2536706 | 3/1977 |
| JP | S57-119419 | 7/1982 |
| JP | 4-133223 | 5/1992 |
| JP | 2004-164948 | 6/2004 |

OTHER PUBLICATIONS

Espacenet English Abstract for German Patent Application Publication No. 2536706, published Mar. 3, 1977.

Espacenet English Abstract for German Patent Application Publication No. 2536740, published Feb. 24, 1977.

Japanese Platform for Patent Information, Publication No. 2004-164948 published Jun. 10, 2004.

Taiwanese Office Action in application No. 106111975, dated Mar. 14, 2018.

National Intellectual Property Administration English abstract for Chinese Patent Publication No. 1194447A, published Sep. 30, 1998.

Espacenet English abstract for Chinese Patent Publication No. 104425187 A, published Mar. 18, 2015.

Japanese Platform for Patent Information English abstract for Japanese Patent Publication No. 4-133233, published May 7, 1992.

Chinese Office Action dated Sep. 4, 2018 in Application No. 201710290096.3.

* cited by examiner

LEFT ⟷ RIGHT

ELECTROMAGNETIC RELAY

CROSS-REFERENCE TO RELATED APPLICATION

This application is based upon and claims the benefit of priority of the prior Japanese Patent Application No. 2016-092754 filed on May 2, 2016, the entire contents of which are incorporated herein by reference.

FIELD

A certain aspect of the embodiments is related to an electromagnetic relay.

BACKGROUND

Conventionally, there has been known an electromagnetic relay in which a fixed terminal having a fixed contact and a movable terminal having a movable contact are press-fitted into a base (e.g. see Japanese Laid-open Patent Publication No. 2004-164948). Each of the fixed terminal and the movable terminal includes a projection for press fitting. The projection for press fitting is press-fitted into a slit provided on the base, and the fixed terminal and the movable terminal are fitted to the base.

SUMMARY

According to an aspect of the present invention, there is provided an electromagnetic relay including: a base unit that includes a slit having a first wall part and a second wall part, and a first projection projecting from the first wall part of the slit; a terminal that is press-fitted into the slit, and includes a second projection at a position opposite to the first projection; and a preventer that prevents deviation of the second projection against the first projection when the terminal is press-fitted into the slit.

The object and advantages of the invention will be realized and attained by the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

Figure 1:
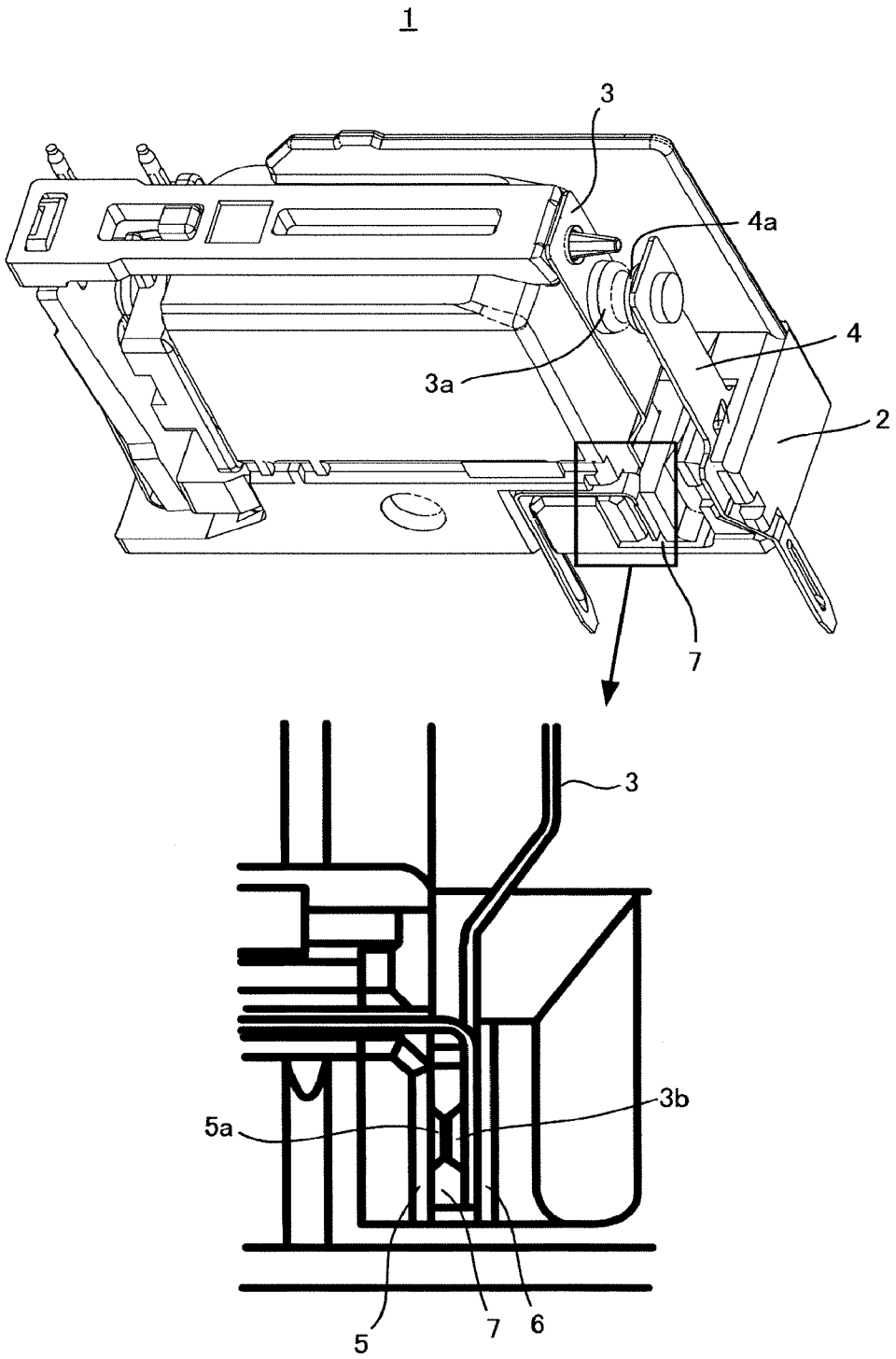
FIG. 1 is a diagram illustrating the configuration of an electromagnetic relay and a periphery of a movable terminal according to a comparative example.

FIG. 1 is a diagram illustrating the configuration of an electromagnetic relay and a periphery of a movable terminal according to a comparative example. An electromagnetic relay 1 of FIG. 1 includes a base block 2, a movable terminal 3 having a movable contact 3*a*, and a fixed terminal 4 having a fixed contact 4*a*. Moreover, the movable terminal 3 includes a press-fitting projection 3*b*. A slit 7 in which wall parts 5 and 6 are opposite to each other is formed on the base block 2. The wall part 5 includes a projection 5*a*. When the movable terminal 3 is press-fitted into the slit 7, the press-fitting projection 3*b* contacts the projection 5*a* and the movable terminal 3 is fixed to the slit 7. Similarly, the fixed terminal 4 also includes a press-fitting projection. The press-fitting projection contacts a projection of a wall part of the base block 2, and hence the fixed terminal 4 is fixed to a slit.

However, in the electromagnetic relay 1 of FIG. 1, the press-fitting projection 3*b* deviates up and down from the projection 5*a* or deviates right and left (i.e. in a depth direction) from the projection 5*a*, and hence torsion might occur in the movable terminal 3. For this reason, the position of the movable contact 3*a* deviates from an appropriate position, and hence a stable contact position cannot be secured. A similar problem occurs in the fixed terminal 4, too.

A description will now be given of an embodiment according to the present invention with reference to drawings.

Figure 2:
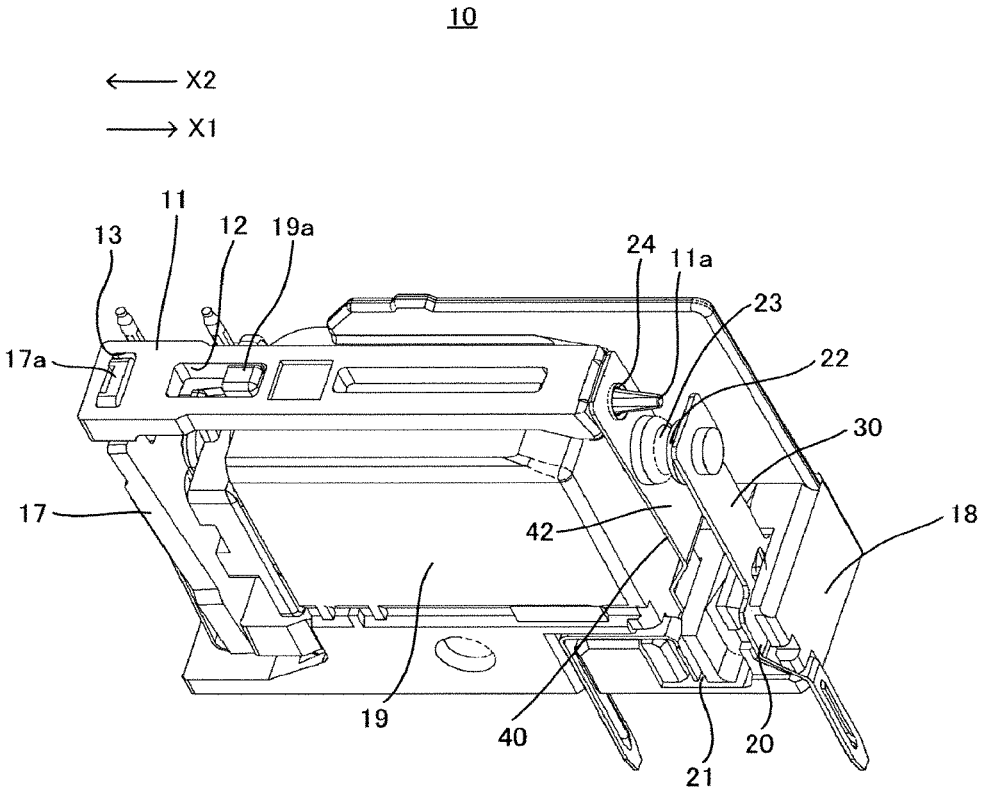
FIG. 2 is a diagram illustrating the configuration of an electromagnetic relay according to a present embodiment.
Figure 3:
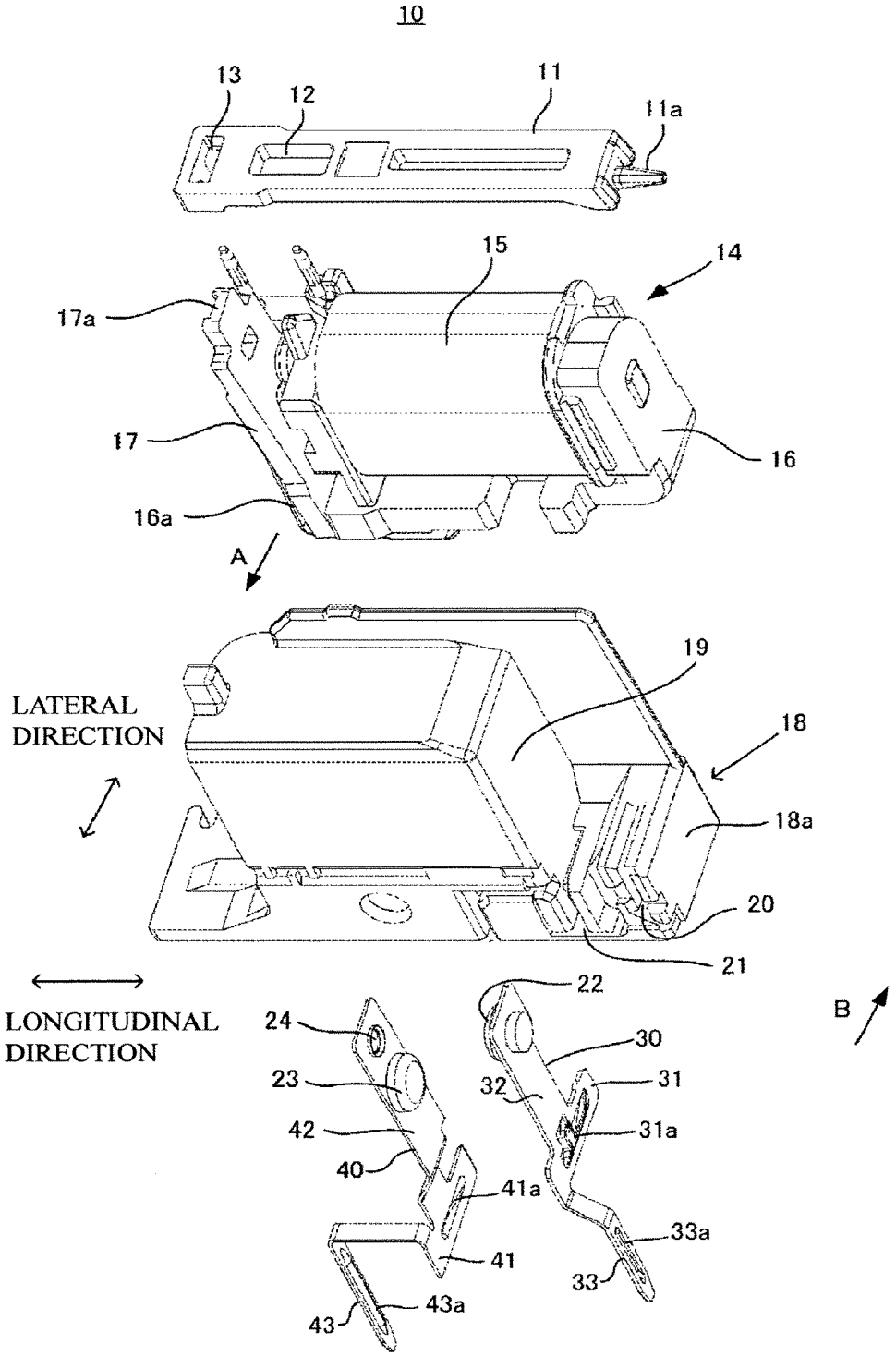
FIG. 3 is an exploded perspective view of the electromagnetic relay according to the present embodiment.
Figure 4A:
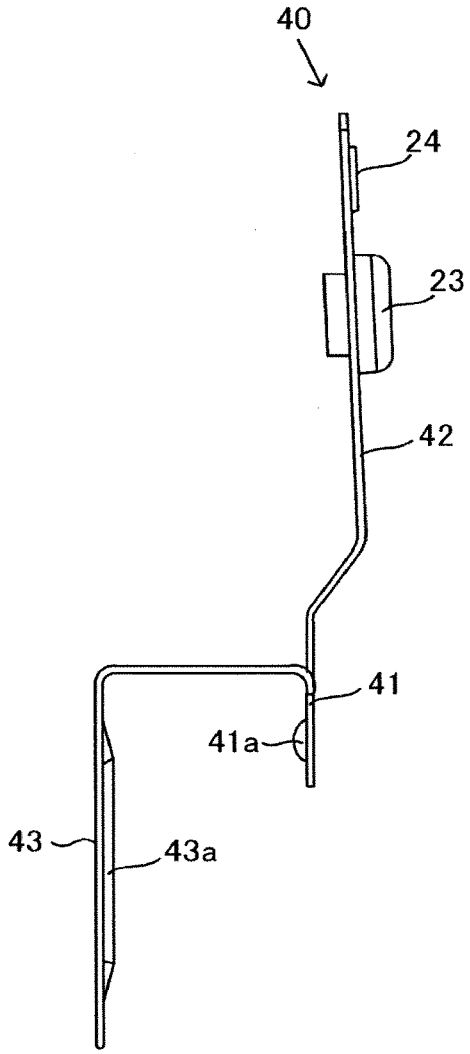
FIG. 4A is a side view of a movable terminal.
Figure 4B:
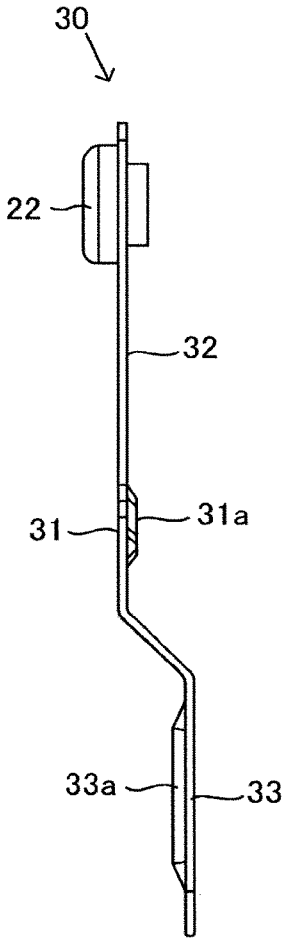
FIG. 4B is a side view of a fixed terminal.

FIG. 2 is a diagram illustrating the configuration of an electromagnetic relay according to a present embodiment. FIG. 3 is an exploded perspective view of the electromagnetic relay according to the present embodiment. FIG. 4A is a side view of a movable terminal. FIG. 4B is a side view of a fixed terminal.

An electromagnetic relay 10 includes a card 11, an electromagnetic unit 14, a base block 18 as a base unit, a fixed terminal 30 and a movable terminal 40. The card 11 includes a projection 11*a* for coupling a hole 24 of the movable terminal 40, a through hole 12 for housing a projection 19*a* of the base block 18, and a through hole 13 into which a tip part 17*a* of an armature 17 is inserted.

The electromagnetic unit 14 includes an electromagnet 15, a yoke 16 and the armature 17. One end of an iron core of the electromagnet 15 is coupled with the yoke 16, and the yoke 16 is coupled with the armature 17 via a plate spring 16*a*.

The base block 18 is made of a resin, and includes a bottom part 18*a* into which the fixed terminal 30 and the movable terminal 40 are press-fitted and a housing part 19 for housing the electromagnetic unit 14. A space (not shown) is formed in the housing part 19. By moving the electromagnetic unit 14 in a direction of an arrow A of FIG. 3, the electromagnetic unit 14 is housed in the space. The projection 19*a* which is inserted into the through hole 12 of the card 11 is formed on an upper surface of the housing part 19. A slit 20 into which the fixed terminal 30 is press-fitted in a direction of an arrow B of FIG. 3 and a slit 21 into which the movable terminal 40 is press-fitted in the direction of the arrow B of FIG. 3 are formed on the bottom part 18*a* of base block 18. That is, the fixed terminal 30 and the movable terminal 40 are press-fitted from a side surface of the electromagnetic relay 10 toward a lateral direction (i.e., the direction of the arrow B of FIG. 3) of the electromagnetic relay 10.

The fixed terminal 30 and the movable terminal 40 are formed by punching out a copper plate and performing press working. The fixed terminal 30 includes an intermediate portion 31 extending in a press-fitting direction (i.e., the lateral direction of the electromagnetic relay 10) toward the slit 20, an upper portion 32 extending vertically upward from the intermediate portion 31, and a lower portion 33 which is bent from the intermediate portion 31 and extends downward. On a top end side of the upper portion 32, a fixed contact 22 is fixed by caulking. On the intermediate portion 31, a T-shaped projection 31*a* is formed by extrusion working or press working, and projects toward an opposite surface (i.e., a right direction of FIG. 4B) from a surface on which the fixed contact 22 is provided. The intermediate portion 31 is press-fitted into the slit 20. The projection 31*a* functions as a second projection.

On the lower portion 33, a projection 33*a* projecting in a longitudinal direction (i.e., a left direction of FIG. 4B) is formed by the extrusion working or the press working. The projection 33*a* extends vertically. To secure conductivity and prevent transformation of the lower portion 33, the projection 33*a* is formed so as to be inserted into a hole, not shown, of a substrate.

The movable terminal 40 includes an intermediate portion 41 extending in the press-fitting direction (i.e., the lateral direction of the electromagnetic relay 10) toward the slit 21, an upper portion 42 which is bent from the intermediate portion 41 and extends upward, and a lower portion 43 which extends in the longitudinal direction of the electromagnetic relay 10 (i.e., the left direction of FIG. 4A) from one end of an upper part of the intermediate portion 41 and extends downward by bending. On a top end side of the upper portion 42, the hole 24 for coupling the projection 11 a of the card 11 is formed. Under the hole 24, a movable contact 23 opposite to the fixed contact 22 is fixed by the caulking. On the intermediate portion 41, a projection 41*a* is formed by the extrusion working or the press working. The projection 41*a* projects toward an opposite surface (i.e., a left direction of FIG. 4A) from a surface on which the movable contact 23 is provided, and extends in the press-fitting direction toward the slit 21. The intermediate portion 41 is press-fitted into the slit 21. The projection 41*a* functions as the second projection.

On the lower portion 43, a projection 43*a* projecting in the longitudinal direction (i.e., a right direction of FIG. 4A) is formed by the extrusion working or the press working. The projection 43*a* extends vertically. To secure conductivity and prevent transformation of the lower portion 43, the projection 43*a* is formed so as to be inserted into a hole, not shown, of the substrate.

A description will be given of operation of the electromagnetic relay 10. When the electromagnet 15 is excited, the armature 17 is attracted by the electromagnet 15 (i.e., a direction of an arrow X1 of FIG. 2). Since the tip part 17*a* of the armature 17 is inserted into the through hole 13 of the card 11, the card 11 moves in the direction of the arrow X1 of FIG. 2. Since the projection 11*a* of the card 11 is coupled with the hole 24 of the movable terminal 40, the upper portion 42 of the movable terminal 40 is also pushed in the direction of the arrow X1 of FIG. 2 and the movable contact 23 contacts the fixed contact 22. Thereby, the electromagnetic relay 10 becomes an ON state. When the excitation of the electromagnet 15 stops, the elastic deformation of the upper portion 42 of the movable terminal 40 is restored and hence the upper portion 42 of the movable terminal 40 pushes the card 11 in a direction of an arrow X2 of FIG. 2. The card 11 moves in the direction of the arrow X2 of FIG. 2. The armature 17 is separated from the electromagnet 15 and is pushed in the direction of the arrow X2 of FIG. 2. Thereby, the electromagnetic relay 10 becomes an OFF state.

Figure 5A:
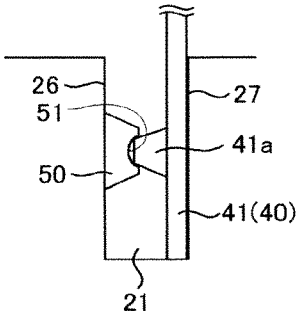
FIG. 5A is a diagram illustrating a state where an intermediate portion of the movable terminal is press-fitted into a slit.
Figure 5B:
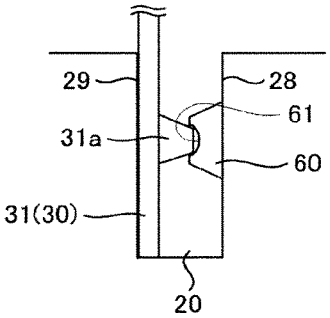
FIG. 5B is a diagram illustrating a state where an intermediate portion of the fixed terminal is press-fitted into a slit.
Figure 5C:
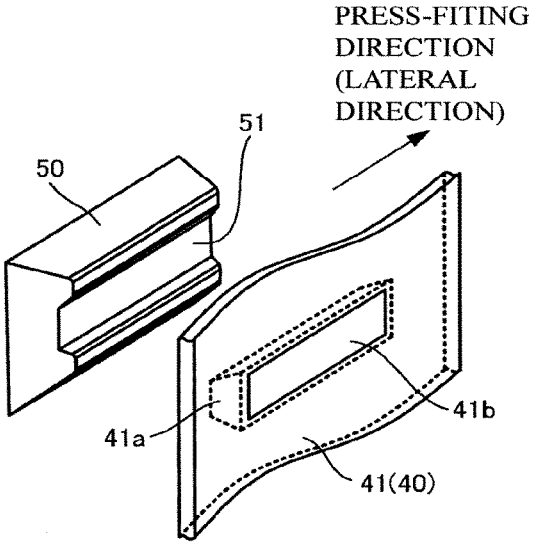
FIG. 5C is a perspective view of a projection to be formed in the slit and the intermediate portion of the movable terminal.
Figure 5D:
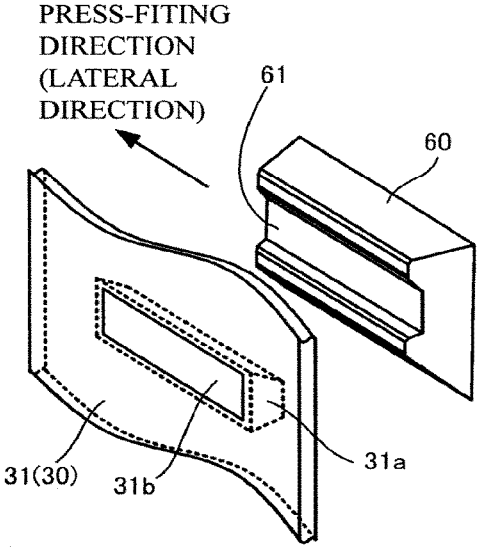
FIG. 5D is a perspective view of a projection to be formed in the slit and the intermediate portion of the fixed terminal.

FIG. 5A is a diagram illustrating a state where the intermediate portion 41 of the movable terminal 40 is press-fitted into the slit 21. FIG. 5B is a diagram illustrating a state where the intermediate portion 31 of the fixed terminal 30 is press-fitted into the slit 20. FIG. 5C is a perspective view of a projection 50 to be formed in the slit 21 and the intermediate portion 41 of the movable terminal 40. FIG. 5D is a perspective view of a projection 60 to be formed in the slit 20 and the intermediate portion 31 of the fixed terminal 30.

As illustrated in FIG. 5A, the slit 21 is formed so that a first wall part 26 is opposite to a second wall part 27 in the base block 18. The projection 50 opposite to the projection 41*a* of the intermediate portion 41 of the movable terminal 40 is formed on the first wall part 26. The projection 50 functions as a first projection. Moreover, a groove 51 that receives and engages with the projection 41*a* is formed on the projection 50. As illustrated in FIG. 5C, the projection 50 and the groove 51 extend in the lateral direction of the electromagnetic relay 10 which is the press-fitting direction toward the slit 21 of the movable terminal 40. Moreover, the projection 41*a* is formed by the press working or the extrusion working, and therefore a hole 41*b* is formed on the back of the projection 41*a*. When the intermediate portion 41 of the movable terminal 40 is press-fitted into the slit 21, the projection 41*a* engages with the groove 51 of the projection 50, and a surface of the intermediate portion 41 at a side on which the movable contact 23 is provided is pressed to the second wall part 27 of the slit 21. Thereby, the alignment of the movable terminal 40 is performed in a thickness direction of the intermediate portion 41, the movable terminal 40 does not deviate in an up and down direction of FIG. 5A, and the torsion of the movable terminal 40 can be suppressed.

As illustrated in FIG. 5B, the slit 20 is formed so that a first wall part 28 is opposite to a second wall part 29 in the base block 18. The projection 60 opposite to the projection 31*a* of the intermediate portion 31 of the fixed terminal 30 is formed on the first wall part 28. The projection 60 functions as the first projection. Moreover, a groove 61 that receives and engages with the projection 31*a* is formed on the projection 60. As illustrated in FIG. 5D, the projection 60 and the groove 61 extend in the lateral direction of the electromagnetic relay 10 which is the press-fitting direction toward the slit 20 of the fixed terminal 30. Moreover, the projection 31*a* is formed by the press working or the extrusion working, and therefore a hole 31*b* is formed on the back of the projection 31*a*. When the intermediate portion 31 of the fixed terminal 30 is press-fitted into the slit 20, the projection 31*a* engages with the groove 61 of the projection 60, and a surface of the intermediate portion 31 at a side on which the fixed contact 22 is provided is pressed to the second wall part 29 of the slit 20. Thereby, the alignment of the fixed terminal 30 is performed in a thickness direction of the intermediate portion 31, the fixed terminal 30 does not deviate in an up and down direction of FIG. 5B, and the torsion of the fixed terminal 30 can be suppressed.

Figure 6A:
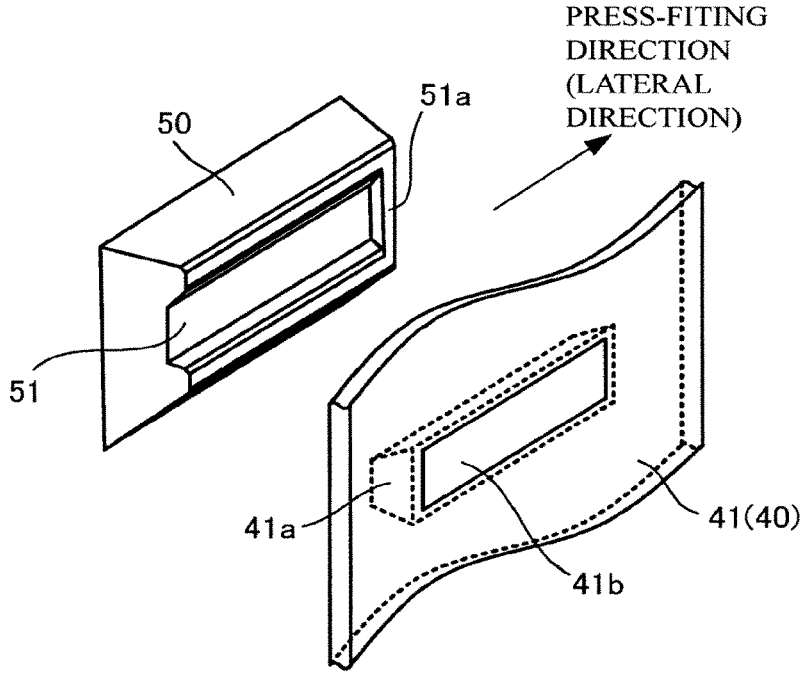
FIG. 6A is a diagram illustrating a variation of the projection to be formed in the slit.
Figure 6B:
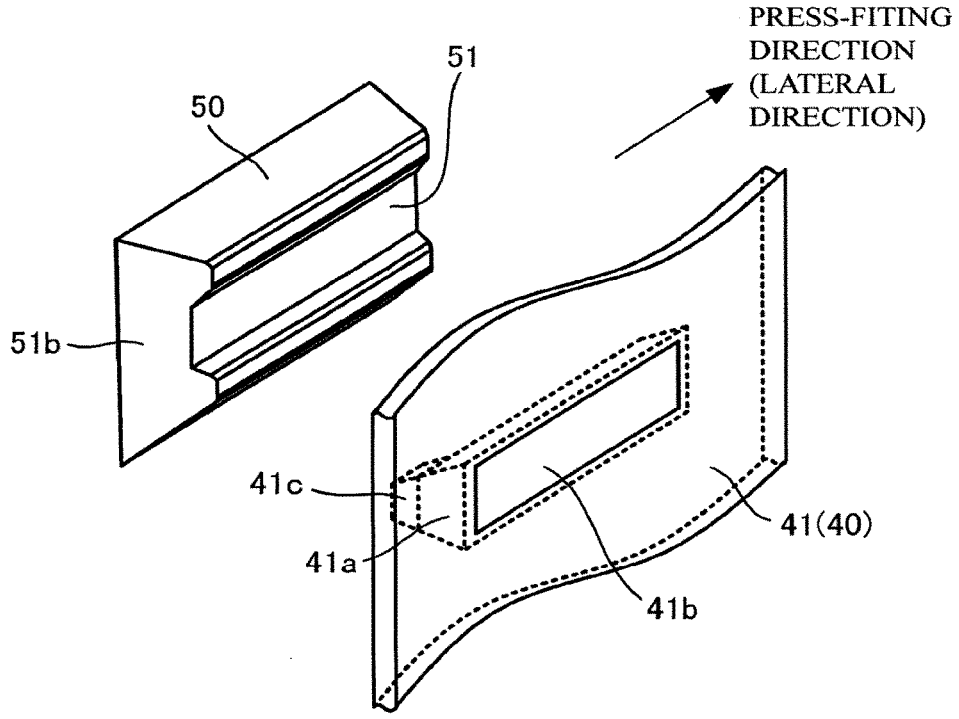
FIG. 6B is a diagram illustrating a variation of the projection of the intermediate portion to be press-fitted into the slit.

FIG. 6A is a diagram illustrating a variation of the projection 50 to be formed in the slit 21. FIG. 6B is a diagram illustrating a variation of the projection 41*a* of the intermediate portion 41 to be press-fitted into the slit 21.

As illustrated in FIG. 6A, the projection 50 may include a stopper 51*a* for stopping the movement of the movable terminal 40 in the press-fitting direction (i.e., the lateral direction of the electromagnetic relay 10) where the movable terminal 40 is press-fitted into the slit 21. When the intermediate portion 41 of the movable terminal 40 is press-fitted into the slit 21, the projection 41*a* of the intermediate portion 41 contacts the stopper 51*a* and the movement of the movable terminal 40 in the press-fitting direction is stopped. Therefore, it is possible to perform the alignment of the movable terminal 40 in the press-fitting direction exactly.

Alternatively, as illustrated in FIG. 6B, the projection 41*a* may include a stopper 41*c* for stopping the movement of the movable terminal 40 in the press-fitting direction (i.e., the lateral direction of the electromagnetic relay 10) where the movable terminal 40 is press-fitted into the slit 21. The stopper 41*c* may be integrally formed with the projection 41*a* by the press working or the extrusion working. When the intermediate portion 41 of the movable terminal 40 is press-fitted into the slit 21, the stopper 41*c* contacts an end face 51*b* of the projection 50 and the movement of the movable terminal 40 in the press-fitting direction is stopped. Therefore, it is possible to perform the alignment of the movable terminal 40 in the press-fitting direction exactly.

Here, the projection 60 of FIG. 5D may include the stopper 51*a* of FIG. 6A. The projection 31*a* of FIG. 5D may include the stopper 41*c* of FIG. 6B. Each of the stopper 51*a* and the stopper 41*c* functions as a stopper.

Figure 7A:
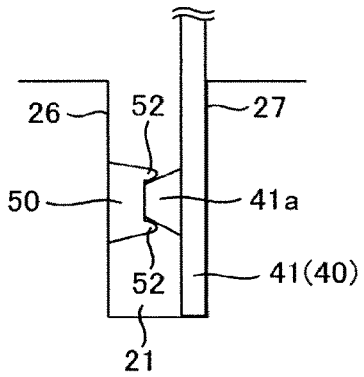
FIG. 7A is a diagram illustrating a first variation of FIG. 5A.
Figure 7B:
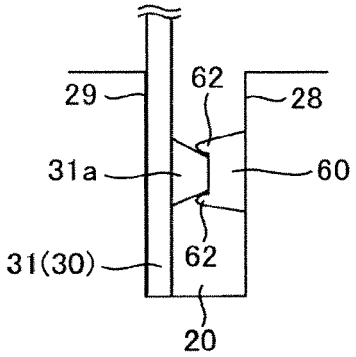
FIG. 7B is a diagram illustrating a first variation of FIG. 5B.
Figure 7C:
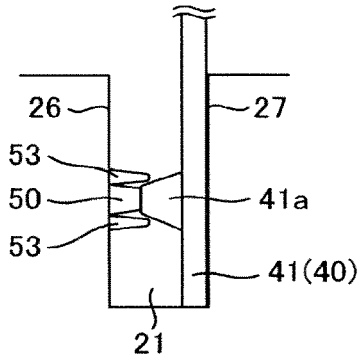
FIG. 7C is a diagram illustrating a second variation of FIG. 5A.
Figure 7D:
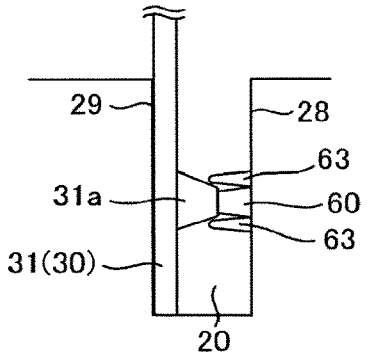
FIG. 7D is a diagram illustrating a second variation of FIG. 5B.
Figure 7E:
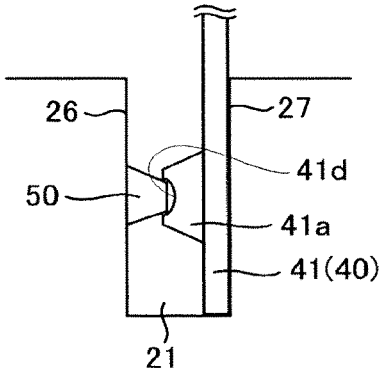
FIG. 7E is a diagram illustrating a third variation of FIG. 5A.
Figure 7F:
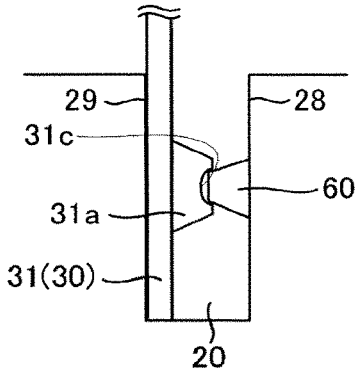
FIG. 7F is a diagram illustrating a third variation of FIG. 5B.
Figure 7F:
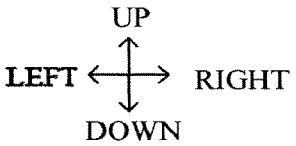
Figure 8A:
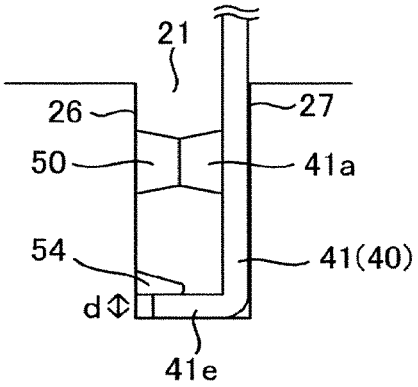
FIG. 8A is a diagram illustrating a fourth variation of FIG. 5A.
Figure 8B:
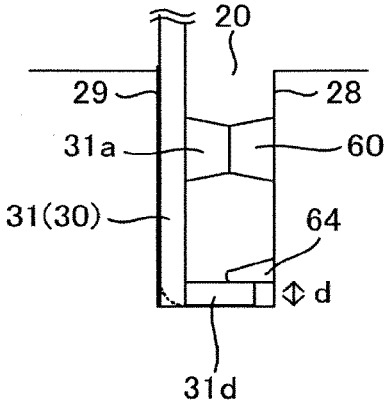
FIG. 8B is a diagram illustrating a fourth variation of FIG. 5B.
Figure 8C:
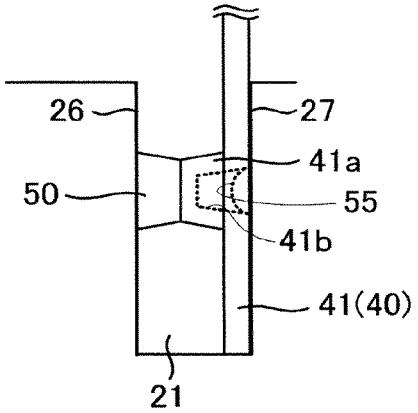
FIG. 8C is a diagram illustrating a fifth variation of FIG. 5A.
Figure 8D:
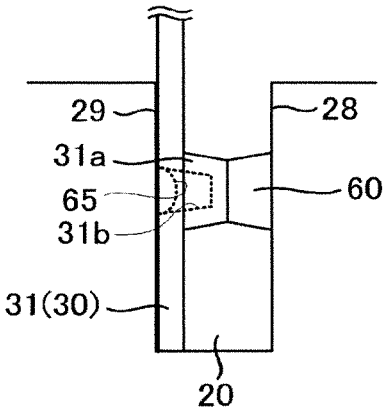
FIG. 8D is a diagram illustrating a fifth variation of FIG. 5B.
Figure 8D:
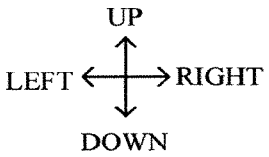

FIG. 7A is a diagram illustrating a first variation of FIG. 5A. FIG. 7B is a diagram illustrating a first variation of FIG. 5B. FIG. 7C is a diagram illustrating a second variation of FIG. 5A. FIG. 7D is a diagram illustrating a second variation of FIG. 5B. FIG. 7E is a diagram illustrating a third variation of FIG. 5A. FIG. 7F is a diagram illustrating a third variation of FIG. 5B. FIG. 8A is a diagram illustrating a fourth variation of FIG. 5A. FIG. 8B is a diagram illustrating a fourth variation of FIG. 5B. FIG. 8C is a diagram illustrating a fifth variation of FIG. 5A. FIG. 8D is a diagram illustrating a fifth variation of FIG. 5B. Corresponding component elements to those in FIGS. 5A and 5B are designated by the same reference numerals, and description of these component elements is omitted.

Protruding parts 52 are formed on the top and bottom of a tip of the projection 50 of FIG. 7A (i.e., the top and bottom of a right end of the projection 50 of FIG. 7A). When the intermediate portion 41 of the movable terminal 40 is press-fitted into the slit 21, the projection 41*a* is sandwiched between the protruding parts 52. Therefore, the movable terminal 40 does not deviate in a vertical direction of FIG. 7A, and the torsion of the movable terminal 40 can be suppressed.

Protruding parts 62 are formed on the top and bottom of a tip of the projection 60 of FIG. 7B (i.e., the top and bottom of a left end of the projection 60 of FIG. 7B). When the intermediate portion 31 of the fixed terminal 30 is press-fitted into the slit 20, the projection 31*a* is sandwiched between the protruding parts 62. Therefore, the fixed terminal 30 does not deviate in the vertical direction of FIG. 7B, and the torsion of the fixed terminal 30 can be suppressed.

The tip of the projection 50 of FIG. 7C (i.e., the right end of the projection 50 of FIG. 7C) is flat. Then, protruding parts 53 which function as a third projection are formed on the first wall part 26 so as to sandwich the projection 50. In FIG. 7C, a distance of the protruding part 53 in a horizontal direction is longer than that of the projection 50 in the horizontal direction. That is, a height of the protruding part 53 is higher than that of the projection 50. When the intermediate portion 41 of the movable terminal 40 is press-fitted into the slit 21, the projection 41*a* contacts the projection 50 and is sandwiched between the protruding parts 53. Therefore, the movable terminal 40 does not deviate in the vertical direction of FIG. 7C, and the torsion of the movable terminal 40 can be suppressed.

The tip of the projection 60 of FIG. 7D (i.e., the left end of the projection 60 of FIG. 7D) is flat. Then, protruding parts 63 which function as the third projection are formed on the first wall part 28 so as to sandwich the projection 60. In FIG. 7D, a distance of the protruding part 63 in the horizontal direction is longer than that of the projection 60 in the horizontal direction. That is, the height of the protruding part 63 is higher than that of the projection 60. When the intermediate portion 31 of the fixed terminal 30 is press-fitted into the slit 20, the projection 31*a* contacts the projection 60 and is sandwiched between the protruding parts 63. Therefore, the fixed terminal 30 does not deviate in the vertical direction of FIG. 7D, and the torsion of the fixed terminal 30 can be suppressed.

The groove 51 is not formed on the tip of the projection 50 of FIG. 7E (i.e., the right end of the projection 50 of FIG. 7E), and a groove 41*d* that receives and engages with the projection 50 is formed on the tip of the projection 41*a* (i.e., the left end of the projection 41*a* of FIG. 7E). The groove 41*d* functions as a concave part. When the intermediate portion 41 of the movable terminal 40 is press-fitted into the slit 21, the projection 50 engages with the groove 41*d*. Therefore, the movable terminal 40 does not deviate in the vertical direction of FIG. 7E, and the torsion of the movable terminal 40 can be suppressed.

The groove 61 is not formed on the tip of the projection 60 of FIG. 7F (i.e., the left end of the projection 60 of FIG. 7F), and a groove 31*c* that receives and engages with the projection 60 is formed on the tip of the projection 31*a* (i.e., the right end of the projection 31*a* of FIG. 7F). The groove 31*c* functions as the concave part. When the intermediate portion 31 of the fixed terminal 30 is press-fitted into the slit 20, the projection 60 engages with the groove 31*c*. Therefore, the fixed terminal 30 does not deviate in the vertical direction of FIG. 7F, and the torsion of the fixed terminal 30 can be suppressed.

Figure 9A:
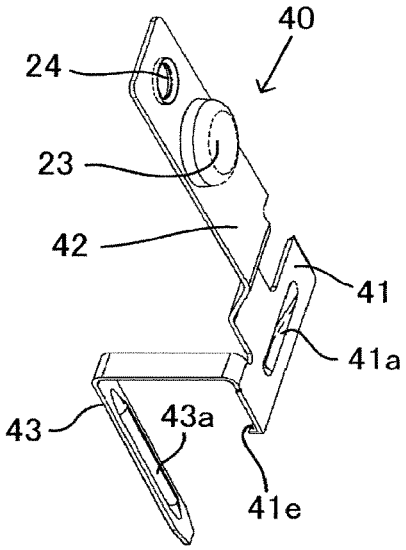
FIG. 9A is a diagram illustrating an example of the movable terminal in which a lower end of the intermediate portion is almost horizontally bent.

The tip of the projection 50 of FIG. 8A (i.e., the right end of the projection 50 of FIG. 8A) is flat, and contacts a flat tip of the projection 41*a* (i.e., the left end of the projection 41*a* of FIG. 8A). In FIG. 8A, a protruding part 54 is formed on the first wall part 26 on which the projection 50 is provided. The protruding part 54 that functions as a fifth projection is formed at a position on the first wall part 26 so that a distance d between the protruding part 54 and a bottom surface of the slit 21 is identical with the thickness of a lower end 41*e* of the intermediate portion 41. The lower end 41*e* of the intermediate portion 41 of the movable terminal 40 is bent roughly perpendicularly to the intermediate portion 41, and is sandwiched between the protruding part 54 and the bottom surface of the slit 21. FIG. 9A illustrates an example of the movable terminal 40 in which the lower end 41*e* of the intermediate portion 41 is bent roughly perpendicularly to the intermediate portion 41. When the intermediate portion 41 of the movable terminal 40 is press-fitted into the slit 21, the lower end 41*e* of the intermediate portion 41 is sandwiched between the protruding part 54 and the bottom surface of the slit 21. Therefore, the movable terminal 40 does not deviate in the vertical direction of FIG. 8A, and the torsion of the movable terminal 40 can be suppressed.

Figure 9B:
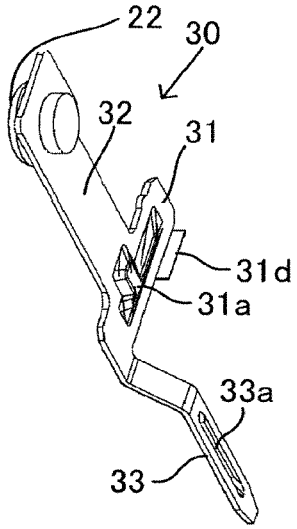
FIG. 9B is a diagram illustrating an example of the fixed terminal in which a lower end of the intermediate portion is almost horizontally bent.

The tip of the projection 60 of FIG. 8B (i.e., the left end of the projection 60 of FIG. 8B) is flat, and contacts a flat tip of the projection 31*a* (i.e., the right end of the projection 31*a* of FIG. 8B). In FIG. 8B, a protruding part 64 is formed on the first wall part 28 on which the projection 60 is provided. The protruding part 64 that functions as the fifth projection is formed at a position on the first wall part 28 so that the distance d between the protruding part 64 and a bottom surface of the slit 20 is identical with the thickness of a lower end 31*d*. The lower end 31*d* of the intermediate portion 31 of the fixed terminal 30 is bent roughly perpendicularly to the intermediate portion 31, and is sandwiched between the protruding part 64 and the bottom surface of the slit 20. FIG. 9B illustrates an example of the fixed terminal 30 in which the lower end 31*d* of the intermediate portion 31 is bent roughly perpendicularly to the intermediate portion 31. When the intermediate portion 31 of the fixed terminal 30 is press-fitted into the slit 20, the lower end 31*d* of the intermediate portion 31 is sandwiched between the protruding part 64 and the bottom surface of the slit 20. Therefore, the fixed terminal 30 does not deviate in the vertical direction of FIG. 8B, and the torsion of the fixed terminal 30 can be suppressed.

The tip of the projection 50 of FIG. 8C (i.e., the right end of the projection 50 of FIG. 8C) is flat, and contacts the flat tip of the projection 41*a* (i.e., the left end of the projection 41*a* of FIG. 8C). In FIG. 8C, the projection 50 is formed on the first wall part 26, and a projection 55 is formed on the second wall part 27 so as to be opposite to the projection 50. The projection 55 that functions as a fourth projection engages with the hole 41*b* formed on the back of the projection 41*a*. When the intermediate portion 41 of the movable terminal 40 is press-fitted into the slit 21, the projection 50 contacts the projection 41*a*, and the projection 55 that is formed on the second wall part 27 so as to be opposite to the projection 50 engages with the hole 41*b* formed on the back of the projection 41*a*. Therefore, the movable terminal 40 does not deviate in the vertical direction of FIG. 8C, and the torsion of the movable terminal 40 can be suppressed.

The tip of the projection 60 of FIG. 8D (i.e., the left end of the projection 60 of FIG. 8D) is flat, and contacts the flat tip of the projection 31*a* (i.e., the right end of the projection 31*a* of FIG. 8D). In FIG. 8D, the projection 60 is formed on the first wall part 28, and a projection 65 is formed on the second wall part 29 so as to be opposite to the projection 60. The projection 65 that functions as the fourth projection engages with the hole 31*b* formed on the back of the projection 31*a*. When the intermediate portion 31 of the fixed terminal 30 is press-fitted into the slit 20, the projection 60 contacts the projection 31*a*, and the projection 65 that is formed on the second wall part 29 so as to be opposite to the projection 60 engages with the hole 31*b* formed on the back of the projection 31*a*. Therefore, the fixed terminal 30 does not deviate in the vertical direction of FIG. 8D, and the torsion of the fixed terminal 30 can be suppressed.

Here, each projection 50 of FIGS. 7A, 7C, 7E, 8A and 8C may include the stopper 51*a* of FIG. 6A. Each projection 41*a* of FIGS. 7A, 7C, 7E, 8A and 8C may include the stopper 41*c* of FIG. 6B. Moreover, each projection 60 of FIGS. 7B, 7D, 7F, 8B and 8D also may include the stopper 51*a* of FIG. 6A. Each projection 31*a* of FIGS. 7B, 7D, 7F, 8B and 8D also may include the stopper 41*c* of FIG. 6B.

As described above, according to the present embodiment, the electromagnetic relay 10 includes a first preventer for preventing the deviation of the projection 41*a* against the projection 50 when the movable terminal 40 is press-fitted to the slit 21.

Specifically, the first preventer is any one of (i) the groove 51 that is formed on the tip of the projection 50 and receives the projection 41*a* (see FIG. 5A), (ii) the plurality of protruding parts 52 that are formed on the tip of the projection 50 and sandwich the projection 41*a* (see FIG. 7A), (iii) the plurality of protruding parts 53 that protrude from the first wall part 26, are adjacent to and higher than the projection 50, and sandwich the projection 50 (see FIG. 7C), (iv) the groove 41*d* that is formed on the tip of the projection 41*a* and receives the projection 50 (see FIG. 7E), (v) the protruding part 54 that protrudes from the first wall part 26 and is arranged so that the distance from the bottom surface of the slit 21 is identical with the thickness of the lower end 41*e* of the intermediate portion 41 of the movable terminal 40 (see FIG. 8A), and (vi) the projection 55 that projects from the second wall part 27 so as to be opposite to the projection 50, and engages with the hole 41*b* formed on the back of the projection 41*a* (see FIG. 8C).

Moreover, the electromagnetic relay 10 includes a second preventer for preventing the deviation of the projection 31*a* against the projection 60 when the fixed terminal 30 is press-fitted to the slit 20.

Specifically, the second preventer is any one of (i) the groove 61 that is formed on the tip of the projection 60 and receives the projection 31*a* (see FIG. 5B), (ii) the plurality of protruding parts 62 that are formed on the tip of the projection 60 and sandwich the projection 31*a* (see FIG. 7B), (iii) the plurality of protruding parts 63 that protrude from the first wall part 28, are adjacent to and higher than the projection 60, and sandwich the projection 60 (see FIG. 7D), (iv) the groove 31*c* that is formed on the tip of the projection 31*a* and receives the projection 60 (see FIG. 7F), (v) the protruding part 64 that protrudes from the first wall part 28 and is arranged so that the distance from the bottom surface of the slit 20 is identical with the thickness of the lower end 31*d* of the intermediate portion 31 of the fixed terminal 30

(see FIG. 8B), and (vi) the projection 65 that projects from the second wall part 29 so as to be opposite to the projection 60, and engages with the hole 31*b* formed on the back of the projection 31*a* (see FIG. 8D).

Therefore, the deviation and the torsion of the movable terminal 40 and the fixed terminal 30 can be suppressed by the first preventer and the second preventer.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various change, substitutions, and alterations could be made hereto without departing from the spirit and scope of the invention.

What is claimed is:

1. An electromagnetic relay comprising:

a base unit that includes a top, a bottom and a side between the top and the bottom, a slit defined by a first wall part and a second wall part to open to the top and the side of the base unit, and a first projection projecting from the first wall part outwardly toward the second wall part;

a terminal that is press-fitted into the slit in a first, press-fitting direction into the side of the base unit parallel to the bottom of the base unit, and includes a second projection at a position opposite to the first projection and projecting outwardly toward the first wall part; and a preventer formed on one of the first and second projections that extends in the first press-fitted direction, and prevents the terminal from moving in a second direction perpendicular to the first direction.

2. The electromagnetic relay as claimed in claim 1, wherein the preventer is a concave part that is formed on the first projection and receives the second projection.

3. The electromagnetic relay as claimed in claim 1, wherein the preventer is protruding parts that are formed on the first projection and sandwich the second projection.

4. The electromagnetic relay as claimed in claim 1, wherein the preventer is third projections that are adjacent to the first projection and formed on the first wall part, each of the third projections being higher than the first projection.

5. The electromagnetic relay as claimed in claim 1, wherein the preventer is a concave part that is formed on the second projection and receives the first projection.

6. The electromagnetic relay as claimed in claim 1, wherein the preventer is a fourth projection that projects from the second wall part so as to be opposite to the first projection, and the fourth projection engages with a concave part formed on the back of the second projection when the terminal is press-fitted into the slit.

7. The electromagnetic relay as claimed in claim 1, wherein the preventer is a fifth projection arranged on the first wall part so that a distance from a bottom surface of the slit is identical with a thickness of a part of the terminal, and the part of the terminal is sandwiched between the bottom surface of the slit and the fifth projection when the terminal is press-fitted into the slit.

8. The electromagnetic relay as claimed in claim 1, wherein at least one of the first projection and the second projection includes a stopper for stopping the movement of the terminal in a press-fitting direction where the terminal is press-fitted into the slit.

9. The electromagnetic relay as claimed in claim 1, wherein the preventer comprises a linear groove extending in the first direction defined by two spaced linear projections extending in the first direction.

* * * * *